US007688566B2

(12) United States Patent
Zhang

(10) Patent No.: US 7,688,566 B2
(45) Date of Patent: Mar. 30, 2010

(54) ELECTRIC FIRING DEVICE FOR FIREWORKS

(76) Inventor: Fan Zhang, Juyuan Xiaoqu, South Shaoshan Road, No. 401, Building 3, Xiangyin Apartment, Changsha (CN) 410007

( * ) Notice: Subject to any disclaimer, the term of this patent is extended or adjusted under 35 U.S.C. 154(b) by 0 days.

(21) Appl. No.: 12/118,826

(22) Filed: May 12, 2008

(65) Prior Publication Data

US 2008/0212256 A1 Sep. 4, 2008

Related U.S. Application Data

(63) Continuation of application No. PCT/CN2006/003097, filed on Nov. 17, 2006.

(30) Foreign Application Priority Data

Nov. 22, 2005 (CN) ..... 2005 2 0052523 U

(51) Int. Cl.
*F23Q 7/00* (2006.01)

(52) U.S. Cl. ..... 361/248; 361/247

(58) Field of Classification Search ..... 361/247, 361/248; 102/202.11, 206
See application file for complete search history.

(56) References Cited

U.S. PATENT DOCUMENTS

| | | | | |
|---|---|---|---|---|
| 5,123,355 | A * | 6/1992 | Hans et al. | 102/202 |
| 6,874,424 | B2 * | 4/2005 | Bailey et al. | 102/275.11 |
| 6,966,260 | B1 * | 11/2005 | Martinez | 102/202.11 |
| 2001/0022146 | A1 * | 9/2001 | Duvacquier et al. | 102/202.2 |

* cited by examiner

*Primary Examiner*—Jared J Fureman
*Assistant Examiner*—Christopher J Clark
(74) *Attorney, Agent, or Firm*—Matthias Scholl P.C.; Matthias Scholl

(57) ABSTRACT

An electric firing device for fireworks comprising a circuit board (7) fixed inside of a mounting clip (8); a firing slot (6) set in the front of the circuit board (7); a resistance wire (5) welded on the circuit board (7) together with a conductive wire pair (9) and straddled on said U shaped firing slot (6); a firework lead wire slot (4) set on the mounting clip (8); and a lead wire propulsion stop plate (2) set on a top cover (1) and engaged with the mounting clip (8). The resistance wire (5) is made of a resistance wire with good electricity to heat conversion capability (such as tungsten wire, nichrome wire, constantan wire, and so on) and spirally-wound.

13 Claims, 2 Drawing Sheets

ELECTRIC FIRING DEVICE FOR FIREWORKS

CROSS-REFERENCE TO RELATED APPLICATIONS

This application is a continuation of International Patent Application No. PCT/CN2006/003097, with an international filing date of Nov. 17, 2006, designating the United States, now pending, which is based on Chinese Patent Application No. 200520052523.7, filed Nov. 22, 2005. The contents of these specifications are incorporated herein by reference.

BACKGROUND OF THE INVENTION

FIELD OF THE INVENTION

The invention relates to an electric firing device, and particularly, to a powderless electric firing device for fireworks having a stable performance.

Conventional electric firing devices contain black powder. The black powder is usually packed in a resistance wire short-circuited at one end of the conductive wire pair, and is affixed to the wire by means of adhesive and moisture-proofing agent. To fire, electrical current is directed to the resistance wire so as to rapidly heat the resistance wire, and in turn, to fire the powder packed around it. The flame and high temperature generated from the combustion of the black powder functions to fire the lead wire of the fireworks.

In order to improve the firing efficiency of the electric firing device, high sensitive powder has been being used. This, however, results in high sensitivity of the electric firing device itself, which may misfire by friction or shock, causing potential danger during the assembly of fireworks. Therefore, although the explosion grade of electric firing devices containing black powder is low (defined as grade UN0454, 1.4S internationally), many countries classify it as controlled product, that only professionals are allowed to purchase. On the other hand, the oxidant in the black powder has high oxidative capacity. Though the resistance wire being used in the electric firing device is made of inert alloy wire, it will be oxidized gradually by the black powder, leading to a dramatic decrease of its heat generation capacity and a high rate of failure. Accordingly, much improvement in the area of electric firing devices for fireworks exists.

SUMMARY OF THE INVENTION

Therefore, according to the drawbacks described above, it is an objective of the invention to provide a powderless electric firing device having stable performance and high safety.

In order to realize the above objective, there is provided an electric firing device, comprising: a circuit board, a pair of conductive wires, a resistance wire, a mounting clip, and a top cover.

In a class of this embodiment, the circuit board is fixed in the mounting clip.

In another class of this embodiment, the front end of the circuit board is set with a U shaped firing slot.

In another class of this embodiment, the resistance wire is welded on the circuit board with the conductive wires together, and is straddled on the U-shaped firing slot.

In another class of this embodiment, a firework lead wire slot is set in the mounting clip.

In another class of this embodiment, a lead wire propulsion stop plate is set on the top cover and is engaged with the mounting clip.

In another class of this embodiment, the resistance wire made of resistance wire having good electricity to heat conversion capability (such as tungsten wire, nichrome wire, constantan wire, and so on) is spirally-wound.

In accordance with the invention, when in use, a lead wire of a firework is inserted into the firework lead wire slot of the mounting clip. When the top cover is pressed, the propulsion stop plate of the top cover forces the lead wire of the firework to embed and fix in the lead wire slot of the mounting clip. The spirally-wound heating resistance wire is welded in the firing slot of the circuit board, and the firework lead wire is embedded into the firing slot of the circuit board. The spirally-wound resistance wire is forcedly-bent by the firework lead wire, and thus serves to cover well the lower portion of the firework lead wire. A supply of electricity will cause the resistance wire to heat, and thus to bum a cotton thread layer of the lead wire to fire the powder in the lead wire, and thereby, to fire the lead wire.

The electric firing device does not contain black powder, and the absence of strong oxidizer around the resistance wire will increase the shelf life of the device. As a result, the electric firing device of the invention has a high safety coefficient and reliability, a simple structure, is easy to manufacture, free from black powder and not regulated.

DETAILED DESCRIPTION OF THE EMBODIMENTS

Figure 1:
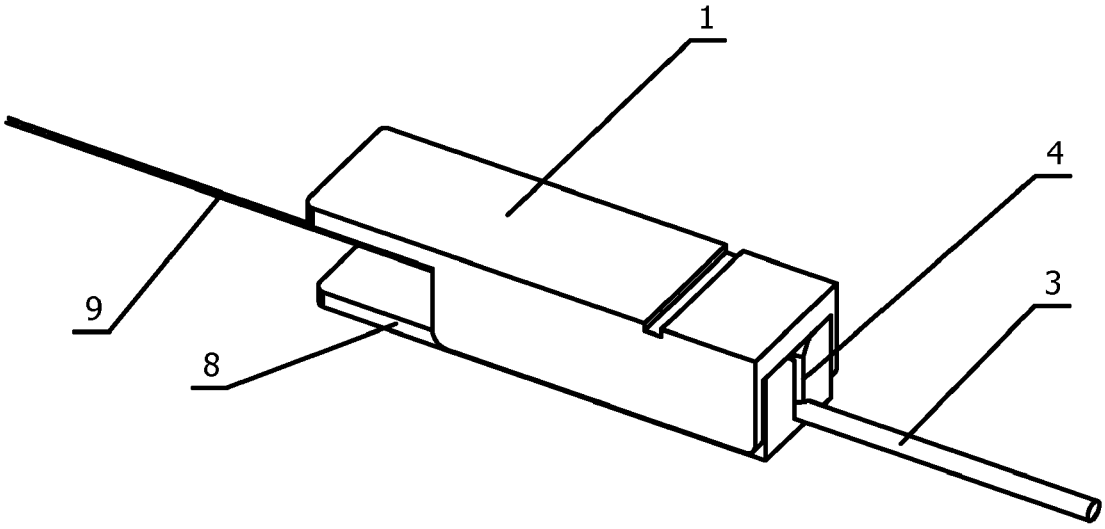
FIG. 1 is a structural view of a firework electric firing device according to one embodiment of the invention.
Figure 2:
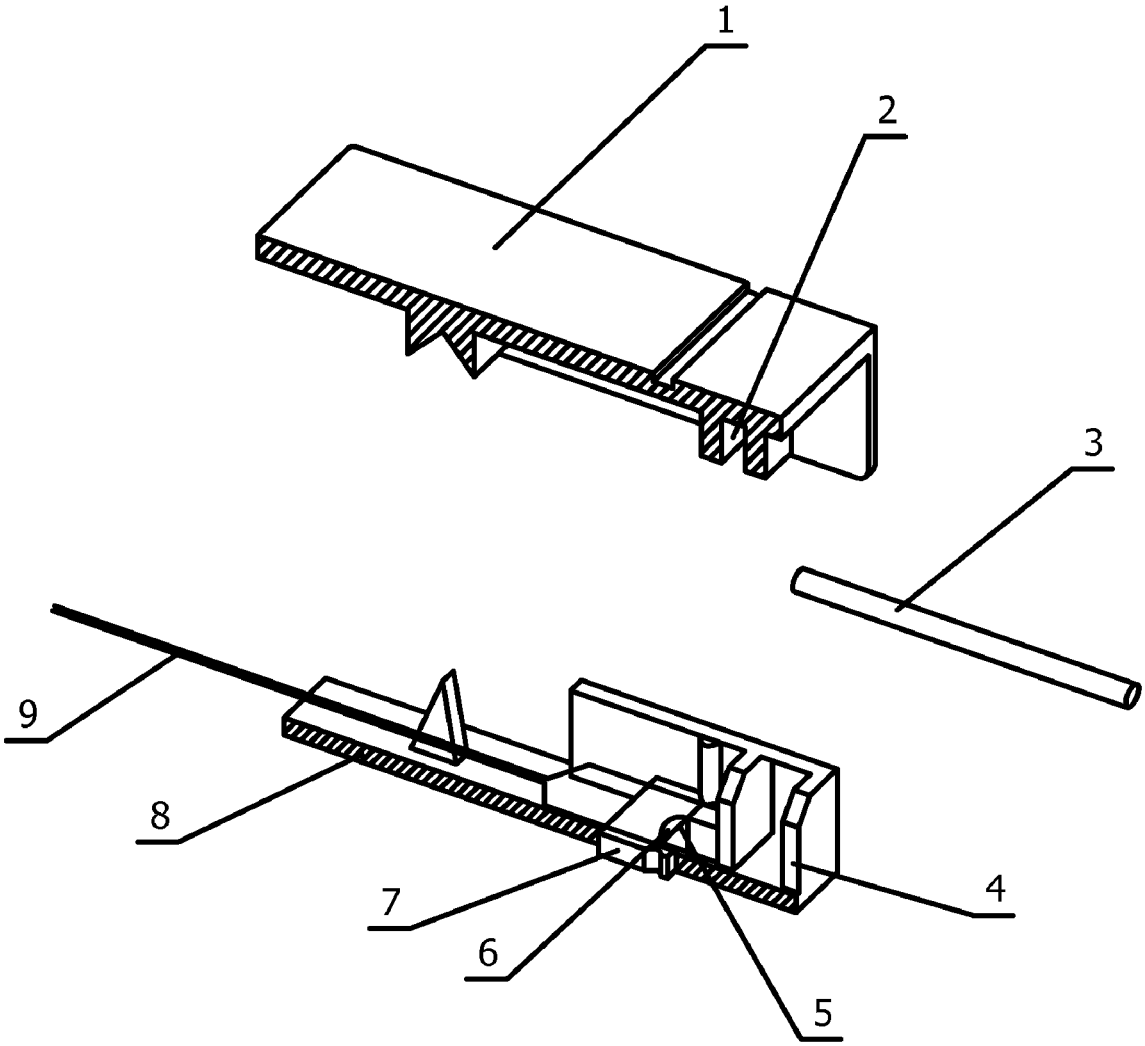
FIG. 2 is an exploded view of a firework electric firing device according to one embodiment of the invention.

With reference to FIGS. 1-2, a circuit board 7 is fixed inside of a mounting clip 8. A U shaped firing slot 6 is set in the front of the circuit board 7. A resistance wire 5 is welded on the circuit board 7 together with a conductive wire pair 9 and is straddled on the U shaped firing slot 6. A firework lead wire slot 4 is set on the mounting clip 8. A lead wire propulsion stop plate 2 is set on a top cover 1 and is engaged with the mounting clip 8. The resistance wire 5 made of resistance wire with good electricity to heat conversion capability (such as tungsten wire, nichrome wire, constantan wire, and so on) is spirally wound and is welded on the U shaped firing slot 6 of the circuit board 7.

When the device of the invention is being used, the lead wire 3 of the firework is inserted into the firework lead wire slot 4 of the mounting clip 8. When the top cover 1 is pressed to close the device, the propulsion stop plate 2 of the top cover 1 forces the lead wire 3 of the firework to embed and fix in the lead wire slot 4 of the mounting clip 8.

The resistance wire 5 is made of resistance wire having good electricity to heat conversion capability (such as tungsten wire, nichrome wire, constantan wire, and so on). The firework lead wire 3 is embedded into the firing slot 6 of the circuit board 7. The spirally wound resistance wire 5 is forcedly-bent by the firework lead wire 3, and thus serves to cover well the lower portion of the firework lead wire 3. A supply of electricity will cause the resistance wire 5 to heat, and thus to burn a cotton thread layer of the lead wire 3 to fire the powder in the lead wire, and thereby, to fire the lead wire 3.

Although the invention has been described in connection with preferred embodiments thereof, it will be appreciated by those skilled in the art that additions, modifications, substitutions and deletions not specifically described may be made without departing from spirit and scope of the invention as defined in the claims.

What is claimed is:

1. An electric firing device for fireworks, comprising: a circuit board, a pair of conductive wires, a resistance wire, a mounting clip, and a top cover, wherein said circuit board is fixed in said mounting clip; the front end of said circuit board is set with a firing slot; said resistance wire is welded on said circuit board together with said conductive wires, and is straddled on said firing slot; a firework lead wire slot is set in said mounting clip; and a lead wire propulsion stop plate is set on said top cover and is engaged with said mounting clip.

2. The device of claim 1, wherein said firing slot is U-shaped.

3. The device of claim 1, wherein said resistance wire has a good electricity to heat conversion capability and is spirally-wound.

4. The device of claim 2, wherein said resistance wire has a good electricity to heat conversion capability and is spirally-wound.

5. The device of claim 3, wherein said resistance wire is made of tungsten, a non-magnetic alloy of nickel and chromium, or a copper-nickel alloy.

6. The device of claim 4, wherein said resistance wire is made of tungsten, a non-magnetic alloy of nickel and chromium, or a copper-nickel alloy.

7. An electric firing device for fireworks, comprising:

a mounting clip with a firework lead wire slot adapted to receive a firework lead wire, a circuit board disposed on said mounting clip, said circuit board comprising a firing slot adapted to receive the firework lead wire;

a resistance wire connected to a pair of conductive wires, said resistance wire being straddled across said firing slot; and a top cover with a lead wire propulsion stop plate, said top cover being adapted to fit onto said mounting clip, whereby forcing the firework lead wire to become fixed in said firework lead wire slot.

8. The device of claim 7, wherein said firing slot is U-shaped.

9. The device of claim 8, wherein said resistance wire has a good electricity to heat conversion capability and is spirally-wound.

10. The device of claim 9, wherein said resistance wire is made of tungsten, a non-magnetic alloy of nickel and chromium, or a copper-nickel alloy.

11. An electric firing device for fireworks, comprising:

a mounting clip with a firework lead wire slot adapted to receive a firework lead wire, a circuit board disposed on said mounting clip, said circuit board comprising a U-shaped firing slot adapted to receive the firework lead wire;

a resistance wire connected to a pair of conductive wires, said resistance wire being straddled across said firing slot and across said circuit board; and a top cover with a lead wire propulsion stop plate, said top cover being adapted to fit onto said mounting clip, whereby forcing the firework lead wire to embed and become fixed in said firework lead wire slot and said fifing slot.

12. The device of claim 11, wherein said resistance wire has a good electricity to heat conversion capability and is spirally-wound.

13. The device of claim 12, wherein said resistance wire is made of tungsten, a non-magnetic alloy of nickel and chromium, or a copper-nickel alloy.

* * * * *